US006206257B1

(12) United States Patent
Peele et al.

(10) Patent No.: US 6,206,257 B1
(45) Date of Patent: Mar. 27, 2001

(54) SWIVEL BELT CLIP WITH BI-DIRECTIONAL ACTION

(75) Inventors: James Calvin Peele; Cathelene Thomas Shanaberger, both of Raleigh, NC (US)

(73) Assignee: Ericsson Inc., Research Triangle Park, NC (US)

( * ) Notice: Subject to any disclaimer, the term of this patent is extended or adjusted under 35 U.S.C. 154(b) by 0 days.

(21) Appl. No.: 09/425,751

(22) Filed: Oct. 22, 1999

(51) Int. Cl.[7] ..... B65D 25/52

(52) U.S. Cl. ..... 224/197; 224/270; 224/271; 224/272; 224/930; 24/597

(58) Field of Search ..... 224/195, 197, 224/198, 199, 200, 270, 271, 272, 930; 24/3.12, 3.5, 597

(56) References Cited

U.S. PATENT DOCUMENTS

| | | | | |
|---|---|---|---|---|
| 5,730,342 | * | 3/1998 | Tien | 224/271 |
| 5,850,996 | * | 12/1998 | Liang | 224/197 X |
| 6,006,969 | * | 12/1999 | Kim | 224/197 |
| 6,059,156 | * | 5/2000 | Lehtinen | 224/197 |
| 6,098,858 | * | 8/2000 | Laugesen | 224/197 |

OTHER PUBLICATIONS

Ericsson Belt Clip Figure—SXK 107 6835 R2A, Date Unknown.

* cited by examiner

*Primary Examiner*—Stephen K. Cronin

(74) *Attorney, Agent, or Firm*—Wood, Phillips, VanSanten, Clark & Mortimer

(57) ABSTRACT

A releasable holder for a portable communication device including a base clip adapted to secure to a carrier such as a belt and an article clip adapted to secure to the portable communication device. The base clip includes a channel having a bottom and side walls extending between open opposite ends with overlying flanges on both side walls spaced a selected distance from the channel bottom, and a locking tab extending into an opening in the channel bottom, a biasing member biasing the locking tab into the channel bottom opening. The base clip is securable to the carrier with the channel in a generally horizontal orientation. Two user engageable release tabs adjacent the channel opposite ends are adapted to move the locking tab against the biasing of the biasing member responsive to movement of one release tab toward the other. The article clip includes a locking head adapted to slide in the channel, the locking head having a width greater than the spacing between the channel flanges and no greater than the spacing between the side walls, a height no greater than the selected distance of the channel flanges from the channel bottom, an end disposed adjacent the channel bottom when the locking head is in the channel, the end including a tapered outer portion and an inner recess in one end adapted to receive the release tab when aligned therewith.

13 Claims, 3 Drawing Sheets

SWIVEL BELT CLIP WITH BI-DIRECTIONAL ACTION

BACKGROUND OF THE INVENTION

1. Technical Field

The present invention is directed toward devices for attaching personal articles, and more particularly toward clips for carrying personal communication devices such as cellular telephones.

2. Background Art

Devices for releasably carrying personal articles are well known in the art. For example, with personal communication devices such as cellular telephones it is desirable to be able to carry these devices without having to uncomfortably place them in the user's pocket. Thus, swivel belt clips readily attachable to belts have been commonly provided with such devices, allowing the user to insert the device into the top of the clip and secure it thereto, with the user then able to carry the device on his or her belt until it is desired to use the device.

While such belt clips can be convenient, they can require a certain height which can be uncomfortable when worm. Also, they can be awkward to use when releasing the device. For example, pulling the phone up out of the clip can instead result in the clip being carried with the device and detached from the wearers belt. As another example, the wearer may find that he or she is in a position in which some object is located above the device and clip and therefore hinders or blocks the device from being easily removed.

The present invention is directed toward overcoming one or more of the problems set forth above.

SUMMARY OF THE INVENTION

In one aspect of the present invention, a releasable holder for a personal article is provided, comprising a base clip and an article clip adapted to secure to the personal article. The base clip includes a channel open on opposite ends, a locking tab biased toward projecting into the channel, and a first release tab engageable by a user for retracting the locking tab from the channel. The article clip includes a locking head adapted to slide in the channel, where the locking head includes a tapered outer portion adapted to force the release tab from the channel when engaged by the outer portion during sliding of the locking head in the channel, and an inner recess in one end adapted to receive the release tab when aligned therewith.

In a preferred form of this aspect of the invention, the base clip is securable to a carrier in a generally horizontal orientation, the carrier in a preferred form being a belt.

In another preferred form, the locking head has a transverse clearance in the channel which is less than the distance which the locking tab projects into the channel.

In still another preferred form, a second release tab is provided and also engageable by a user for retracting the locking tab from the channel. In still further preferred forms, the locking tab extends through an opening in the channel and a spring member biases the locking tab through the hole; the first and second release tabs are respectively disposed adjacent the channel opposite ends; and either of the first and second release tabs is movable toward the other of the first and second release tabs responsive to engagement by a user, each of the release tabs including a cam member adapted to cam the locking tab against its bias when the associated release tab is moved toward the other release tab.

In another aspect of the present invention, a releasable holder for a portable communication device is provided including a base clip adapted to secure to a carrier and an article clip adapted to secure to the portable communication device. The base clip includes a channel having a bottom and side walls extending between open opposite ends with overlying flanges on both side walls spaced a selected distance from the channel bottom, a locking tab extending into an opening in the channel bottom, a biasing member biasing the locking tab into the channel bottom opening, and a first release tab engageable by a user for moving the locking tab against the biasing of the biasing member. The article clip includes a locking head adapted to slide in the channel, the locking head having a width greater than the spacing between the channel flanges and no greater than the spacing between the side walls, a height no greater than the selected distance of the channel flanges from the channel bottom, an end disposed adjacent the channel bottom when the locking head is in the channel, the end including a tapered outer portion and an inner recess in one end adapted to receive the release tab when aligned therewith.

In a preferred form, a clip member is provided on the base clip adapted to secure the base clip to the carrier with the channel in a generally horizontal orientation.

In another preferred form a second release tab is provided engageable by a user for moving the locking tab against the biasing of the biasing member. In preferred forms, the first and second release tabs are respectively disposed adjacent the channel opposite ends, and either of the first and second release tabs is movable toward the other of the first and second release tabs responsive to engagement by a user where each of the release tabs includes a cam member adapted to cam the locking tab against the biasing member when the associated release tab is moved toward the other release tab.

It is an object of the invention to provide a releasable holder which may be used with a variety of devices, and may be easily adapted for reliable secure attachment to many different objects.

It is another object of the invention to provide a releasable holder which may be easily operated in attaching and detaching the device from an object, and accommodates different user preferences and different situations and positions in which the user might find himself or herself when attaching and detaching the device from the object.

It is a further object of the present invention to provide a releasable holder which may be comfortably worn by the user.

DESCRIPTION OF THE PREFERRED EMBODIMENT

Figure 1:
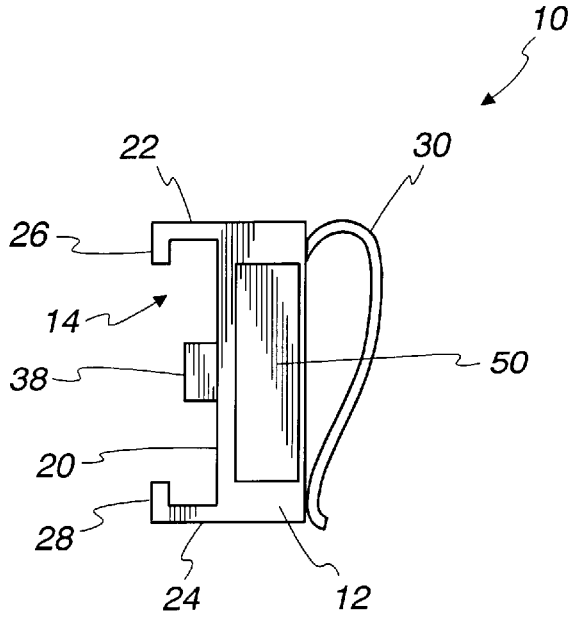
FIG. 1 is an end view of a base clip according to the present invention.
Figure 2:
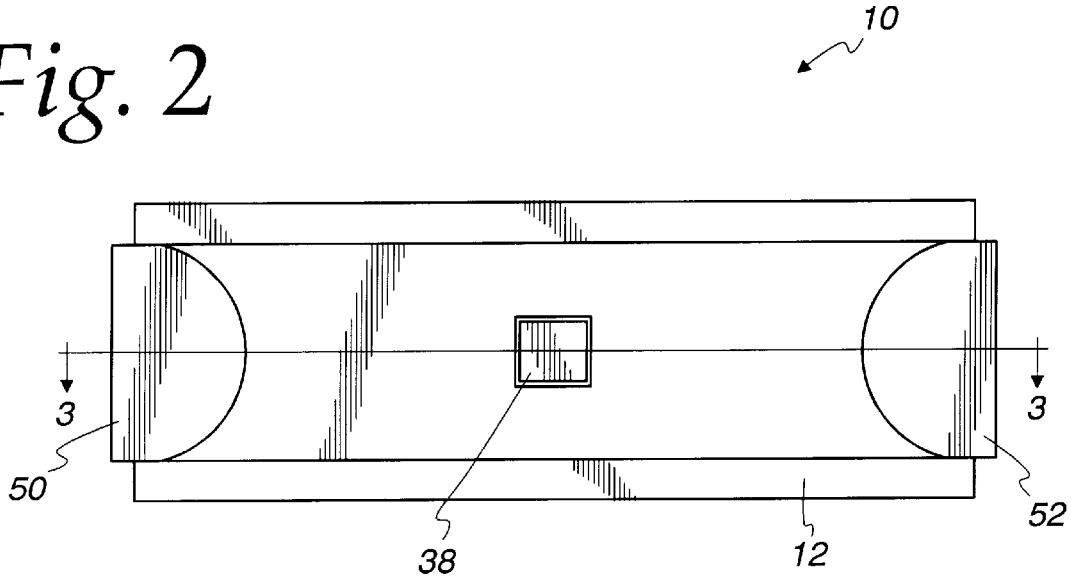
FIG. 2 is a view of the base clip taken from the left of FIG. 1.
Figure 3:
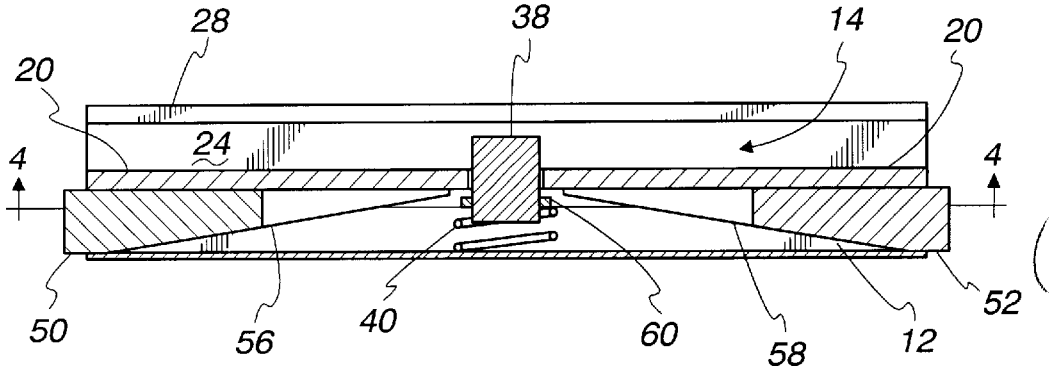
FIG. 3 is a cross sectional view of the base clip taken along line 3—3 of FIG. 2.
Figure 4:
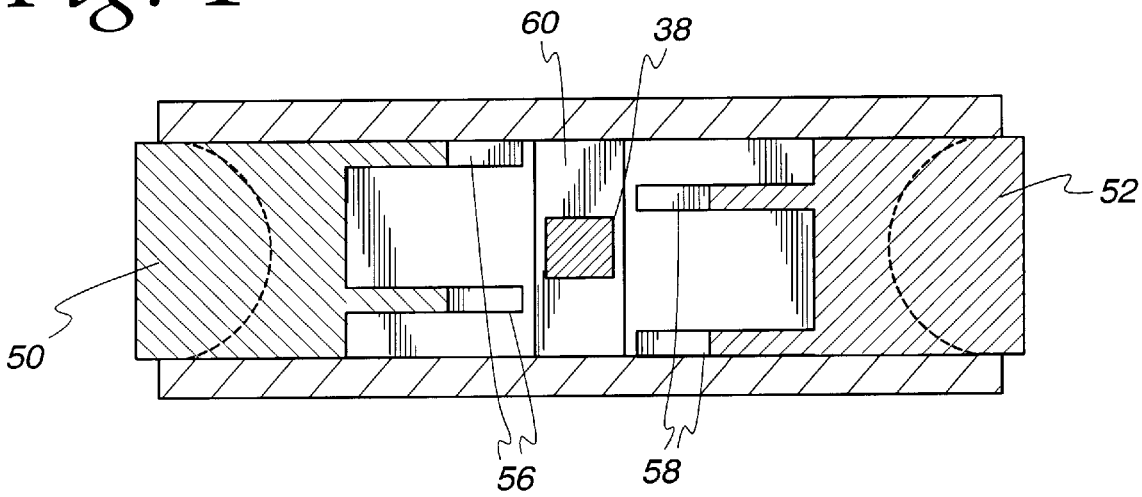
FIG. 4 is a cross sectional view of the base clip taken along line 4—4 of FIG. 3.

One preferred embodiment of the present invention is illustrated in the figures. The base clip 10 of the present invention is shown in FIGS. 1–4.

The base clip 10 includes a body 12 defining a channel 14 defined by a bottom wall 20, side walls 22, 24 and overlying flanges 26, 28. The channel 14 extends the full length of the base clip 10 so that it is open on both ends.

A suitable attachment clip 30 is secured to the side of the base clip body 12 opposite the channel 14. As illustrated in FIG. 1, the attachment clip 30 is a spring hook which may be hooked over a relatively thin item such as a user's belt. In a most preferred embodiment, the attachment clip 30 is oriented relative so that it will secure the base clip 10 with the channel 14 in a generally horizontal orientation.

Still other structures for attaching the base clip 10 to a user carrier could also be used within the scope of the present invention. For example, the base clip could be attachable to something other than a user's belt, or even directly to the user (e.g., it could be attached to luggage) and a suitable clip for attachment to some other such carrier could then be provided. Further, it should be understood that while in the most preferred embodiment the base clip would attach to its carrier so that it causes its channel to be generally oriented horizontally (recognizing that attachment to any moving object such as the wearer's belt is unavoidably going to result in periodic non-horizontal orientation as the wearer moves), in its broadest scope the invention does not require such an orientation.

The channel bottom wall 20 includes an opening therethrough with a locking tab 38 extending therethrough from behind the bottom wall 20. The locking tab 38 is biased by a suitable structure toward the bottom wall opening, as by the compression spring 40 illustrated in FIG. 3. It should be understood that still other biasing structures could be used within the scope of the present invention including, for example, but not limited to, a leaf spring, the point being that the locking tab 38 is in a normal condition caused to extend through the bottom wall 20 and extend into the channel 14 as described in greater detail below.

Suitable release tabs 50, 52 extend from opposite ends of the base clip body 12, and are suitably secured to the body 12 for movement toward the opposite channel end (i.e., toward each other) responsive to engagement by a user. More specifically, in the illustrated embodiment, the release tabs 50, 52 each include tapered legs or cam members 56, 58. The cam members 56, 58 extend toward one another but are offset so as to not interfere with movement toward each other. A cross member 60 is secured to the locking tab 38 and the cam members 56, 58 are disposed between the bottom wall 20 and the cross member 60. Therefore, when either of the release tabs 50 or 52 are moved toward the other, their cam members 56 or 58 will cam the cross member 60 and locking tab 38 against the bias of the spring 40. As will be appreciated once a full understanding of the present invention is had, in a preferred embodiment the cam members 56, 58 will cam the locking tab 38 sufficiently to retract it out of the base clip channel 14. The release tabs 50, 52 are preferably biased outward toward the position shown in FIGS. 2–4 so that the ends of the release tabs 50, 52 extend beyond the end of the body 12 and the release tabs 50, 52 can therefore be pushed sufficiently by a user to provide the desired retraction of the locking tab 38 as detailed further below. Separate bias members (not shown) can be provided for the release tabs 50, 52 or the bias member for the locking tab 38 can also function in that capacity if desired (e.g., by acting on the cam members 56, 58)

In the most preferred embodiment, a pair of release tabs 50, 52 are provided at the opposite channel ends as shown, as this provides an excellent ergonomic design whereby a user may with one hand depress one or both of the release tabs 50, 52 (e.g., by squeezing them together) while at the same time using his or her palm to slide the attached device from the channel 14 (as described further below). However, it should be understood that it would be within the broad scope of the present invention to provide a different mechanism for biasing the locking tab 38 toward, and retracting it from, the channel 14.

Figure 5:
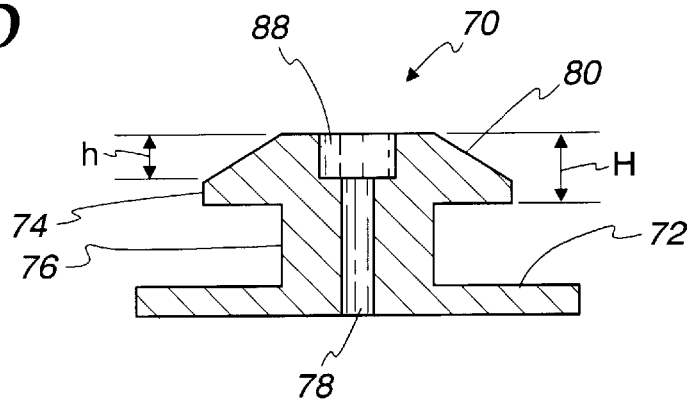
FIG. 5 is a central cross-sectional view of an article clip according to the present invention.
Figure 6:
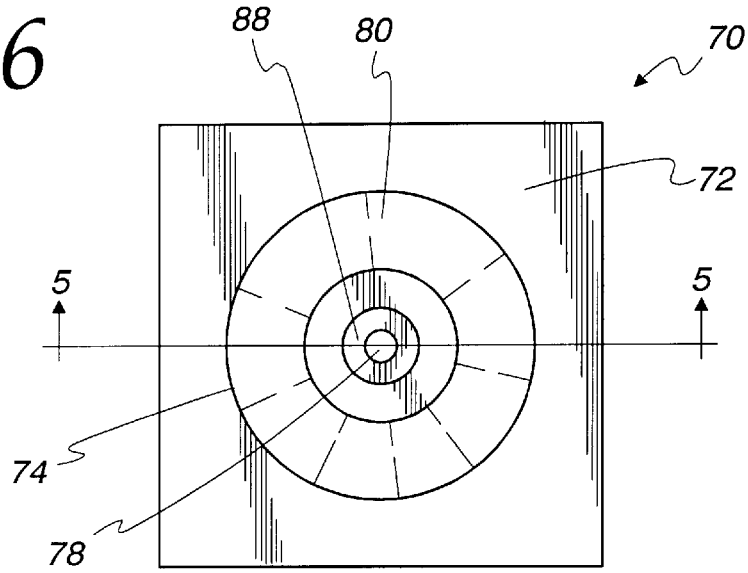
FIG. 6 is a top view of the article clip of FIG. 5.

The article clip 70 is shown in FIGS. 5–6. The article clip 70 preferably includes a base 72, a head 74 spaced from the base by a neck 76, with a central opening 78 therethrough. The article clip 70 is adapted to be suitably attached to the device to be releasably held on the base clip 10, for example by a suitable adhesive or by a suitable fastener (e.g., a screw [now shown] extending through the central opening 78.

The article clip head 74 preferably has a height "H" no greater than the depth of the channel 14 (i.e., the spacing between the channel bottom wall 20 and the channel flanges 26, 28). Thus, the head 74 may be slid into the channel 14 from either end. The outer end of the article clip head 74 is also preferably tapered over a height "h" which is at least as great as the extension of the locking tab 38 into the channel 14. It will thus be appreciated that when the locking tab 38 is slid into the channel 14, the head tapered portion 80 will engage the locking tab 38 and push it down against the force of the spring 40 to allow the head 74 to slide over the locking tab 38.

Figure 7:
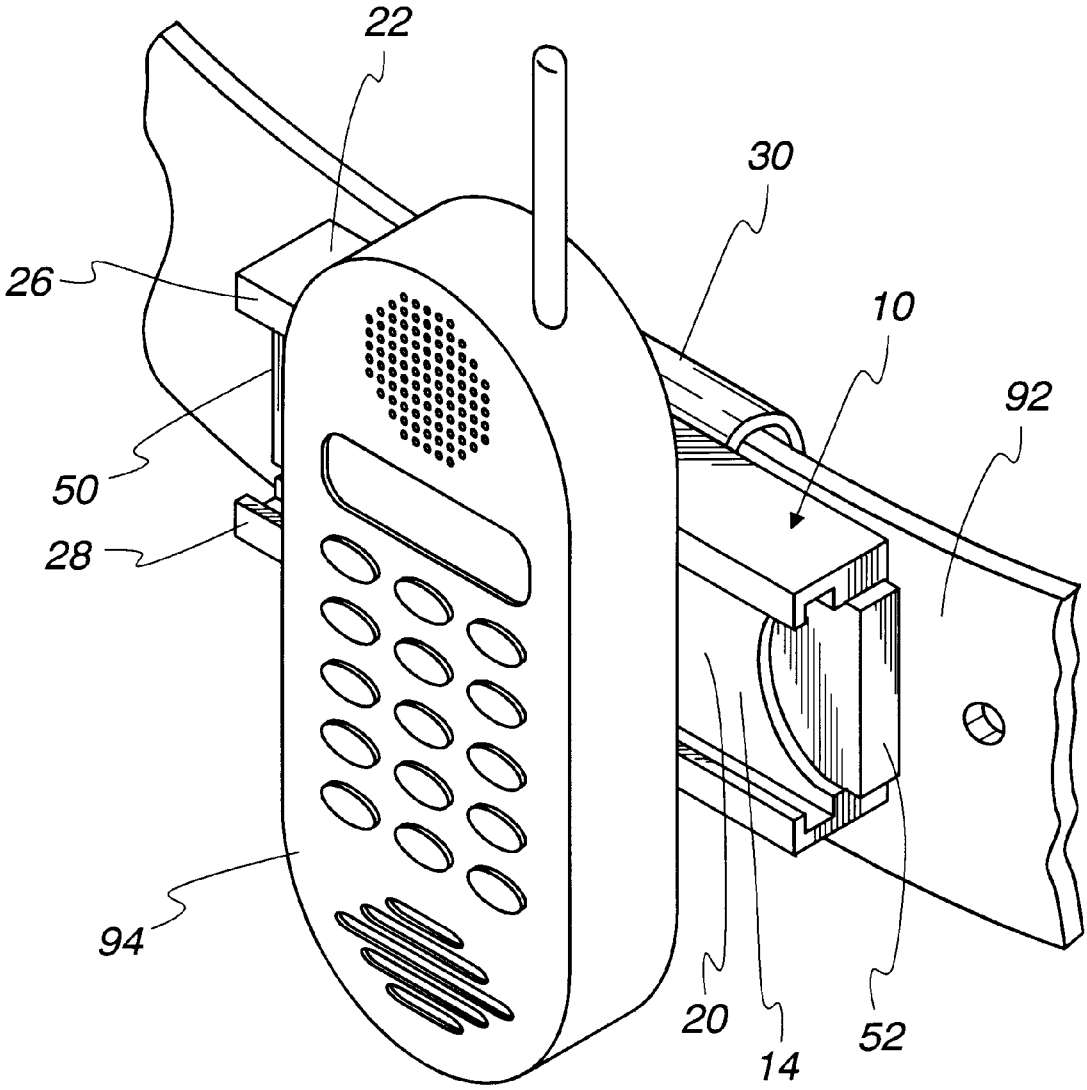
FIG. 7 is a perspective view illustrating a device secured to a belt by a base clip and article clip according to the present invention.

A recess 88 is provided in the end of the head 74 for receiving the locking tab 38 when disposed thereover. Specifically, it should now be appreciated that when the article clip head 74 is slid in the channel 14 of the base clip 10, it will first cause the locking tab 38 to retract from the channel 14 (through the action of the head tapered portion 80) until the head 74 is centered over the locking tab 38, at which point the spring 40 will snap the locking tab 38 back into the channel 14 and into the recess 88 in the end of the article clip head 74, thereby locking the article clip 70 (and its attached article) in the midpoint of the channel 14. This is illustrated in FIG. 7, in which example the base clip 10 is attached to a user carrier such as a belt 92 in a generally horizontal orientation, with a cellular telephone 94 secured to an article clip (hidden behind the phone 94 in FIG. 7). Though described herein as a belt clip for a cellular telephone, it should be recognized that the present invention may be used with not only this and other portable communication devices but also with virtually any device which is desired to be conveniently attached to and detached from another traveling object.

It should also be understood that the size of the base clip 1 0 can be made to match the type of device with which it is intended to be used, as it preferably not extend beyond the sides of the device when in use (the base clip 10 is illustrated wider than necessary in FIG. 7 for illustration purposes).

As best illustrated in FIG. 7, it should be appreciated that the generally horizontal orientation of the base clip 10 provides a minimal vertical footprint and thereby will be comfortable for virtually any wearer as it does not, for example, extend above or below the belt 92. Further, the device (phone 94) can be easily detached (and similarly reattached) by a user simply grasping the device in his or her palm and then depressing at least one of the release tabs 50, 52 to cause the locking tab 38 to be retracted as previously described, freeing the article clip head 74 to slide in the channel 14 to one channel end or the other, releasing the device from the base clip 10. Of course, it should then be appreciated that the above described embodiment may be used on either the right hand or left hand side, with one of the release tabs 50, 52 being suitably positioned for easy manipulation and use in either case.

It should now be recognized that the present invention may be used with a variety of devices, and may be easily adapted for attachment to many different objects including a wearers belt or luggage. Further, the present invention provides easy operation in attaching and detaching the device from the object, as it allows detachment in either of two directions to accommodate both the comfort of use of the individual wearer and the different situations in which the user might find himself or herself (e.g., near something which blocks the device from being comfortably detached in one of the directions). Still further, the present invention presents minimized risk that the base clip will unintentionally be detached from the user when he or she wishes merely to detach the device from the base clip for use of the device. Additionally, the present invention is comfortable particularly when attached to the user's clothes (e.g., when worn as a belt clip).

Still other aspects, objects, and advantages of the present invention can be obtained from a study of the specification, the drawings, and the appended claims. It should be understood, however, that the present invention could be used in alternate forms where less than all of the objects and advantages of the present invention and preferred embodiment as described above would be obtained.

What is claimed is:

1. A releasable holder for a personal article, comprising:

a base clip including a channel open on opposite ends, a locking tab biased toward projecting into said channel, and a first release tab engageable by a user for retracting said locking tab from said channel; and an article clip adapted to secure to the personal article and including a locking head adapted to slide in said channel, said locking head including a tapered outer portion adapted to force said release tab from said channel when engaged by said outer portion during sliding of said locking head in said channel, and an inner recess in one end adapted to receive said release tab when aligned therewith.

2. The releasable holder of claim 1, further comprising means for securing said base clip to a carrier in a generally horizontal orientation.

3. The releasable holder of claim 2, wherein said carrier comprises a belt.

4. The releasable holder of claim 1, wherein said locking head has a transverse clearance in said channel which is less than the distance which said locking tab projects into said channel.

5. The releasable holder of claim 1, further comprising a second release tab engageable by a user for retracting said locking tab from said channel.

6. The releasable holder of claim 5, wherein said locking tab extends through an opening in the channel and further comprising a spring member biasing the locking tab through said hole.

7. The releasable holder of claim 5, wherein said first and second release tabs are respectively disposed adjacent said channel opposite ends.

8. The releasable holder of claim 7, wherein either of said first and second release tabs is movable toward the other of said first and second release tabs responsive to engagement by a user, each of said release tabs including a cam member adapted to cam said locking tab against its bias when said associated release tab is moved toward the other release tab.

9. A releasable holder for a portable communication device, comprising:

a base clip adapted to secure to a carrier, including a channel having a bottom and side walls extending between open opposite ends, said channel further including overlying flanges on both side walls spaced a selected distance from the channel bottom, a locking tab extending into an opening in said channel bottom, a biasing member biasing the locking tab into the channel bottom opening, and a first release tab engageable by a user for moving said locking tab against the biasing of the biasing member; and an article clip adapted to secure to the portable communication device and including a locking head adapted to slide in said channel, said locking head having a width greater than the spacing between said channel flanges and no greater than the spacing between the side walls, a height no greater than the selected distance of the channel flanges from the channel bottom, an end disposed adjacent said channel bottom when said locking head is in said channel, said end including a tapered outer portion, and an inner recess in one end adapted to receive said release tab when aligned therewith.

10. The releasable holder of claim 9, further comprising a clip member on said base clip adapted to secure the base clip to the carrier with the channel in a generally horizontal orientation.

11. The releasable holder of claim 9, further comprising a second release tab engageable by a user for moving said locking tab against the biasing of the biasing member.

12. The releasable holder of claim 11, wherein said first and second release tabs are respectively disposed adjacent said channel opposite ends.

13. The releasable holder of claim 12, wherein either of said first and second release tabs is movable toward the other of said first and second release tabs responsive to engagement by a user, each of said release tabs including a cam member adapted to cam said locking tab against the biasing member when said associated release tab is moved toward the other release tab.

* * * * *